United States Patent [19]

Moynihan

[11] Patent Number: 4,813,310

[45] Date of Patent: Mar. 21, 1989

[54] PLIERS WITH INTERCHANGEABLE JAWS

[76] Inventor: Patrick B. Moynihan, 1517 Charlestowne Dr., Edgewood, Md. 21040

[21] Appl. No.: 113,455

[22] Filed: Oct. 28, 1987

[51] Int. Cl.[4] ..... B25B 7/02

[52] U.S. Cl. ..... 81/423; 81/416; 269/284

[58] Field of Search ..... 81/416, 423, 424, 422, 81/421, 418, 185.1; 403/321, 322, 325, 326, 327, 330; 269/257, 281, 284

[56] References Cited

U.S. PATENT DOCUMENTS

| | | | |
|---|---|---|---|
| 967,436 | 8/1910 | Ramsey | 81/416 |
| 1,505,510 | 8/1924 | Uhl . | |
| 1,556,755 | 10/1925 | Burman . | |
| 2,441,552 | 5/1948 | Barnes | 81/416 |
| 2,606,471 | 8/1952 | Kollweck | 81/423 |
| 2,614,781 | 10/1952 | Engel | 403/327 |
| 3,176,551 | 4/1965 | Hansen . | |
| 3,390,455 | 7/1968 | Florian . | |
| 4,499,798 | 2/1985 | Miskiewicz . | |
| 4,531,520 | 7/1985 | Reggers et al. . | |

FOREIGN PATENT DOCUMENTS

| | | |
|---|---|---|
| 628232 | 2/1963 | Belgium . |
| 364026 | 11/1922 | Fed. Rep. of Germany . |
| 2920841 | 11/1980 | Fed. Rep. of Germany . |

*Primary Examiner*—Frederick R. Schmidt
*Assistant Examiner*—Maurina Rachuba
*Attorney, Agent, or Firm*—Leonard Bloom

[57] ABSTRACT

A pliers having interchangeable and replaceable jaws. Each shank of the pliers have an outwardly projecting stud formed opposite the handle end thereof. A slot is formed in the jaw end of each shank. The slot opens externally of the shank in a direction away from one another. A latch is pivotably mounted in each slot. Each latch has a finger which projects away from the pliers. Each jaw has a recess formed therein, permitting the jaw to be slidably, removably received on a stud. Each jaw further has a notch formed therein having an open end in communication with the recess in the jaw. Resilient means is positioned in each slot for constantly biasing the latch having the finger thereon outwardly of the pliers. When the jaw is slid onto a stud, the finger is received in a respective notch securing the jaw to the stud. A manually-actuatable portion of the latch permits the latch to be depressed against the biasing action of the resilient means, pivoting the finger out of the notch and releasing the jaw. The stud and the recess are inclined inwardly at an acute angle, so that when the jaw is received on the pliers, it is inclined inwardly providing a transverse force component. The jaw is removably mounted on a stud (formed on the shank) with a detent-type of "snap action".

31 Claims, 4 Drawing Sheets

PLIERS WITH INTERCHANGEABLE JAWS

FIELD OF THE INVENTION

The present invention relates to pliers for clamping and unclamping a workpiece and, in particular, to such as pliers which have interchangeable jaws for clamping and unclamping a workpiece therebetween.

BACKGROUND OF THE INVENTION

The use of pliers having interchangeable and replaceable jaws is well known. Such devices are advantageous over common pliers having fixed jaws since they permit a user to, utilizing one pair of pliers, carry out a multitude of unique and special functions such as cutting, punching, embossing, clamping, etc., by simply changing the jaws thereof. In this fashion, a substantial savings of funds, which would otherwise have to be expended for both jaws and pliers, is realized.

The use of interchangeable jaws for pliers has been described in Belgian Pat. No. 628,232 issued to Crisafulli, German Pat. No. 857,480 issued to Extermann; and U.S. Pat. Nos. 1,505,510 issued to Uhl; 1,556,755 issued to Burman; 3,176,551 issued to Hansen; and 4,499,798 issued to Miskiewicz.

Unfortunately, no pliers having interchangeable jaws, of which I am aware, provide for the jaws to be secured in place so that, like the fixed jaw pliers, they are tilted or inclined inwardly, thereby providing a transverse force component for improved gripping. Also, none of the pliers having interchangeable jaws provides a means whereby the jaw may be secured to and/or removed from the pliers with a "snap action". Finally, none of the pliers of which I am aware provide for bearings to be internally retained between the shanks or handle members of pliers for facilitating the operation of the device.

Thus, there remains a need to provide a pliers having interchangeable jaws, wherein the jaws are inclined or tilted inwardly, thereby providing a transverse force component for improved gripping. There also remains a need for such a pliers wherein the jaws may be secured to and/or removed therefrom with a "snap action". Finally, there remains a need to provide a means to facilitate operation of the device.

SUMMARY OF THE INVENTION

Accordingly, it is a primary object of the present invention to provide a pliers for clamping and unclamping a workpiece having interchangeable jaws which are secured to the pliers, wherein the jaws are tilted or inclined inwardly for providing a transverse force component for improved gripping.

It is a further object of the present invention to provide a pliers having replaceable and interchangeable jaws, wherein the jaws may be secured to and/or removed from the pliers with a " snap action".

It is a still further object of the present invention to provide a pliers having a bearing or bearings retained internally in the handle of the pliers at the pivot point therebetween.

It is a yet still further object of the present invention to provide a pliers having interchangeable jaws which are easily secured to and unsecured from the pliers, wherein the pliers are simple to construct and operate, and wherein the pliers are reliable and durable.

In accordance with the teachings of the present invention, a pliers for clamping and unclamping a workpiece is disclosed. These pliers have a pair of shanks. Each of these shanks has a first end and a second opposite end. Each of these shanks is also pivotably connected to each other at a first pivot point. Connected thusly, the shanks are capable of pivotal movement in a first direction, wherein the first ends of each shank are moved towards one another, and in a second opposite direction, wherein the first ends of each shank are moved away from one another. A pair of clamping jaws is provided. Each respective jaw is removably received on a respective first end of a shank for concomitant movement therewith. In this fashion, movement of the shanks in the first direction moves the jaws concomitantly therewith for clamping the workpiece therebetween. Also in this fashion, movement of the shanks in the second opposite direction moves the jaws concomitantly therewith for unclamping the workpiece. Each of the clamping jaws is secured to a respective shank inclined inwardly, thereby providing a transverse force component for clamping of the workpiece therebetween. Means is provided for removably securing each respective clamping jaw on a respective shank, wherein each jaw may be selectively secured to and unsecured from said shank. Finally, means is provided for enabling each jaw to be received on and removed from a respective first end with a "snap action".

In accordance with the further teachings of the present invention, there is disclosed clamping and unclamping a workpiece. There pliers have a pair of shanks. Each of these shanks has a first end and a second opposite end. Each of these shanks are also pivotably connected to each other at a first pivot point. Connected thusly, the shanks are capable of pivotal movement in a first direction, wherein the first ends of each shank are moved towards one another, and in a second opposite direction, wherein the first ends of each shank are moved away from one another. A pair of clamping jaws is provided. Each respective jaw is removably received on a respective first end of a shank for concomitant movement therewith. In this fashion, movement of the shanks in the first direction moves the jaws concomitantly therewith for clamping the workpiece therebetween. Also in this fashion, movement of the shanks in the second opposite direction moves the jaws concomitantly therewith for unclamping the workpiece. Each of the clamping jaws is secured to a respective shank inclined inwardly, thereby providing a transverse force consonant for clamping of the workpiece therebetween. The first end of each respective shank has an outermost stud portion which projects forwardly thereof, substantially away from the second opposite end thereof. Each clamping jaw has a recess which is formed therein being substantially complementary to the stud. In this fashion, the jaw may be slidably and removably received on a respective stud which is formed on a first end of a shank for concomitant movement therewith. The first pivot point is positioned substantially intermediately of the first and second opposite ends of the shank. This first pivot point is further disposed about an axis which is transverse to the pliers. Each of the shanks also has a slot formed therein between the first end and the first pivot point. Each of these slots opens externally of the shanks in a direction away from one another. A latch is pivotably mounted in each slot on a second pivot point about an axis substantially parallel to the transverse axis of the first pivot point. Each of these latches has a finger projecting in a direction away from the transverse axis of the first pivot point. Each jaw has a notch formed therein. Each of these notches has an open end which is in communication with a respective recess to receive a respective finger therein. Resilient means are positioned within each slot for constantly biasing a respective latch outwardly of the pliers. In this fashion, the finger is received in a respective notch, whereby each jaw is removably secured to the stud of a respective shank. Each latch further has a manually actuable portion which may be manually depressed to pivotably depress and move the latch within the slot against the bias of the resilient means. In this manner, the finger clears the notch in the jaw, whereby the jaw is unsecured from the stud of a respective shank for removal therefrom. The finger of each latch has a sloping cam surface. Finally, each notch further includes an edge portion. The sloping cam surfaces of each latch cooperates with the edge portion of a respective notch, whereby each jaw may be received on and removed from a respective first end with a "snap action".

In accordance with the still further teachings of the present invention, there is disclosed a pliers which includes a pair of handle members having a pivotable connection therebetween intermediately of the length of the handle members. The pivotable connection is disposed about an axis transverse to the pliers. The pliers further has a longitudinal axis which is located intermediately of the handle members, substantially passing through the transverse axis perpendicularly thereof. Each of the handle members has an outermost stud portion projecting forwardly thereof away from the pivotable connection between the handle members. A removable jaw is positioned on each stud. Each jaw has a recess formed therein which is complementary to the stud. In this manner, the jaw may be slidably and removably mounted on its respective stud. Means is provided for keying the jaw to the stud against relative rotation therebetween. Each of the handle members further has a slot formed therein between the stud and the pivotable connection between the handle members. The slot opens externally of the handle members in a direction away from the longitudinal axis of the pliers. A latch is pivotably mounted in the slot about an axis substantially parallel to the transverse axis of the pivotable connection between the handle members. Resilient means is positioned within the slot and constantly biases the latch outwardly of the pliers. The latch has a finger projecting in a direction away from the transverse axis. The jaw has a notch formed therein. This notch has an open end which is in communication with the recess to receive the finger. The latch further has a manually-actuable portion which may be depressed to depress the latch within the slot against the bias of the resilient means. In this manner, the finger clears the notch on the jaw releasing the jaw. The jaw may thereafter be removed from the sutd.

In a preferred embodiment, the pliers further includes means enabling the jaw to be received with a "snap action" on its respective stud. This last-named means includes a sloping cam surface formed on the finger of the latch and cooperating with an edge portion of the notch in the jaw.

In accordance with the yet still further teachings of the present invention, there is disclosed a pliers which include a pair of handle members having a pivotable connection therebetween intermediately of the length of the handle members. The pivotable connection is disposed about an axis transverse to the pliers. The pliers further have a longitudinal axis which is intermediately of the handle members and substantially passes through the transverse axis perpendicularly thereof. Each of the handle members has an outermost stud portion which projects forwardly thereof, away from the pivotable connection between the handle members. A removable jaw is positioned on each stud. Each jaw has a recess formed therein which is complementary to the stud. In this manner, the jaw may be slidably and removably mounted on its respective stud. Means is provided for keying the jaw to the stud against relative rotation therebetween. Each of the handle members has a slot formed therein between the stud and the pivotable connection between the handle members. The slot opens externally of the handle members in a direction away from the longitudinal axis of the pliers. A latch is pivotably mounted in the slot about an axis which is substantially parallel to the transverse axis of the pivotable connection between the handle members. Each stud is inclined by an acute angle in a direction towards the longitudinal axis of the pliers. A spring is positioned within the slot and constantly biases the latch outwardly of the pliers. The latch has a finger which projects in a direction away from the transverse axis. The jaw has a notch formed therein. This notch has an open end which is in communication with the recess to receive the finger. The finger has a sloping cam surface which cooperates with an edge portion of the notch in the jaw. The latch further has a manually-actuable portion which may be depressed to depress the latch within the slot. In this fashion, the finger clears the notch on the jaw, such that the jaw may thereafter be removed from the stud and whereby each jaw is received with a "snap action" on its respective stud. The handle member has an arcuate cut-out portion which is adjacent to the slot for receiving the manually-actuatable projecting portion of the latch. Positioned thusly, the manually-actuatable projecting portion of the latch is disposed within the extended contours of the handles members. In this fashion, the user's thumb or finger may be received in the cut-out portion to depress the manually-actuable projecting portion of the latch.

Viewed in another aspect, and in accordance with the teachings of the present invention, there is disclosed a pliers or the like, wherein the pliers has a pair of handle members arranged about a longitudinal axis of the pliers and which are pivotably connected together about an axis which is substantially transverse to the longitudinal axis of the pliers. This pliers include the combination of at least one interchangeable jaw. Means is provided for removably mounting the interchangeable jaw or the pliers in a direction which is inclined inwardly towards the longitudinal axis of the pliers. This last-named means accommodates a spring-loaded detent "snap action" of the interchangeable jaw on the pliers. This same last-named means includes a manually-actuable latch member accessible externally of the pliers. Upon the manual actuation of the latch member, the interchangeable jaw is partially unseated from the jaw, and the interchangeable jaw may thereupon be manually removed from the pliers.

Preferably, an anti-friction bearing, such as a ball bearing or a roller bearing, is provided in the pivotable connection between the shanks.

These and other objects of the present invention will become apparent from a reading of the following specification, taken in conjunction with the enclosed drawings.

DESCRIPTION OF PREFERRED EMBODIMENTS

Figure 1:
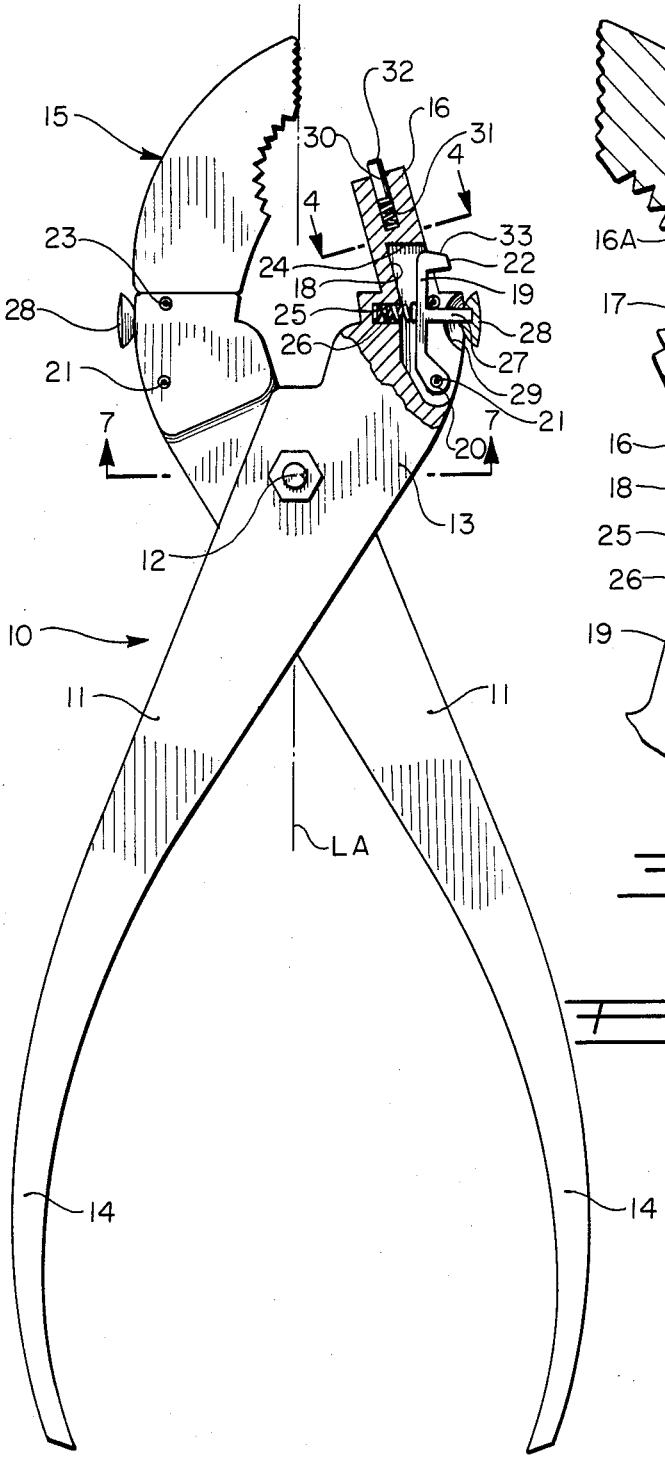
FIG. 1 is a front elevation of the pliers of the present invention, wherein one of the interchangeable jaws is removed therefrom, and wherein certain parts have been broken away and sectioned to illustrate the latching means for the interchangeable jaw.

With reference to FIG. 1, the pliers 10 of the present invention are of the type which has a pair of shanks (handle members) 11. The shanks 11 are pivotably connected to each other at a first pivot point 12 by suitable means well known to those skilled in the art. The pliers 10 are substantially symmetrical, having a longitudinal axis LA substantially intermediately of the shanks 11 which passes through the first pivot point 12.

Each shank 11 has a first end (jaw end) 13 and a second, opposite end (a handle end) 14 which is usually is usually gripped during use of the device 10.

Preferably, the first pivot point (pivotal connection) 12 is located intermediately of the length of the shanks (handle members) 11 being positioned substantially intermediately of the first and second ends, 13 and 14 respectively, of each shank 11. This first pivot point 12 is disposed about a transverse axis TA (see FIG. 7) which is transverse to the pliers 10 and which is substantially perpendicular to and intersects the longitudinal axis LA.

During use of the pliers 10, the shanks 11 are pivotally moved on the first pivot point 12 about the transverse axis TA thereof for pivotal movement in a first direction, wherein the first ends 13 of each shank 11 are moved towards one another and in a second, opposite direction, wherein the first ends 13 of each shank 11 are moved away from one another.

Removably, slidably received on each respective first end 13 is a respective, interchangeable clamping jaw 15. Positioned thusly, each clamping jaw 15 moves concomitantly with the shank 11 on which it is carried. In this fashion, the movement of the shanks 11 in the first direction concomitantly moves the jaws 15 therewith for clamping the workpiece therebetween. Furthermore movement of the shanks 11 in the second direction concomitantly moves the jaws 15 therewith for unclamping of the workpiece.

Each of the jaws 15 is, in a manner that shall be hereinafter discussed, inclined inwardly towards one another and/or towards the longitudinal axis LA. This inward inclination of the clamping jaws provides the device 10 with a transverse force component for improved clamping therebetween.

While illustrated herein as clamping jaws 15, it will be understood by those skilled in the art that any suitable jaw designed for a particular purpose such as cutting, punching or embossing, etc. may also be utilized. Indeed, it is contemplated herein that, in practice, a plurality of replaceable, interchangeable jaws 15 will be provided. It is further contemplated that each pair of jaws 15 will be designed for a different function.

Figure 2:
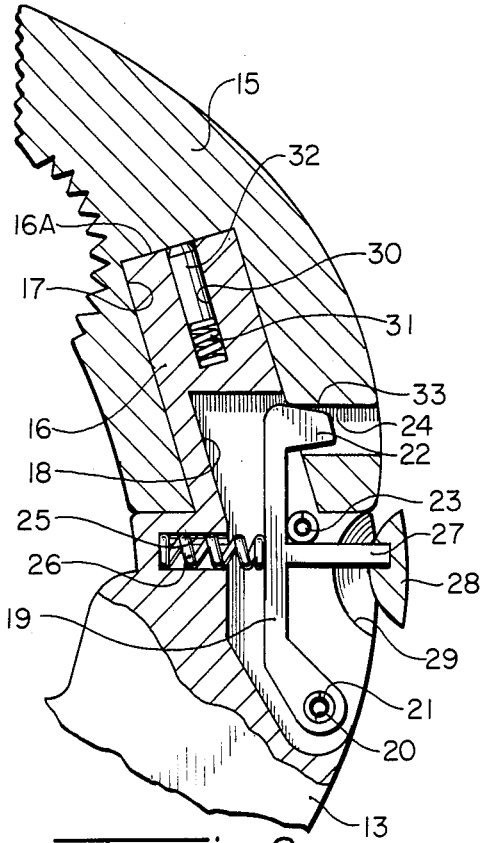
FIG. 2 is a front elevation, drawn to an enlarged scale and with certain parts broken away and sectioned, of the first end (or outermost portion) of one of the shanks having a jaw removably disposed thereon.
Figure 3:
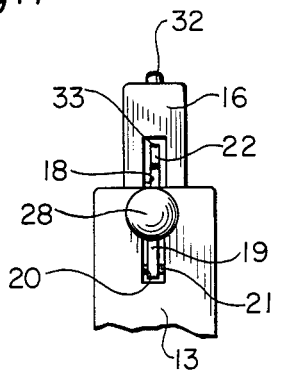
FIG. 3 is a side view of the first end of one of the shanks having one of the interchangeable jaws removed therefrom.
Figure 5:
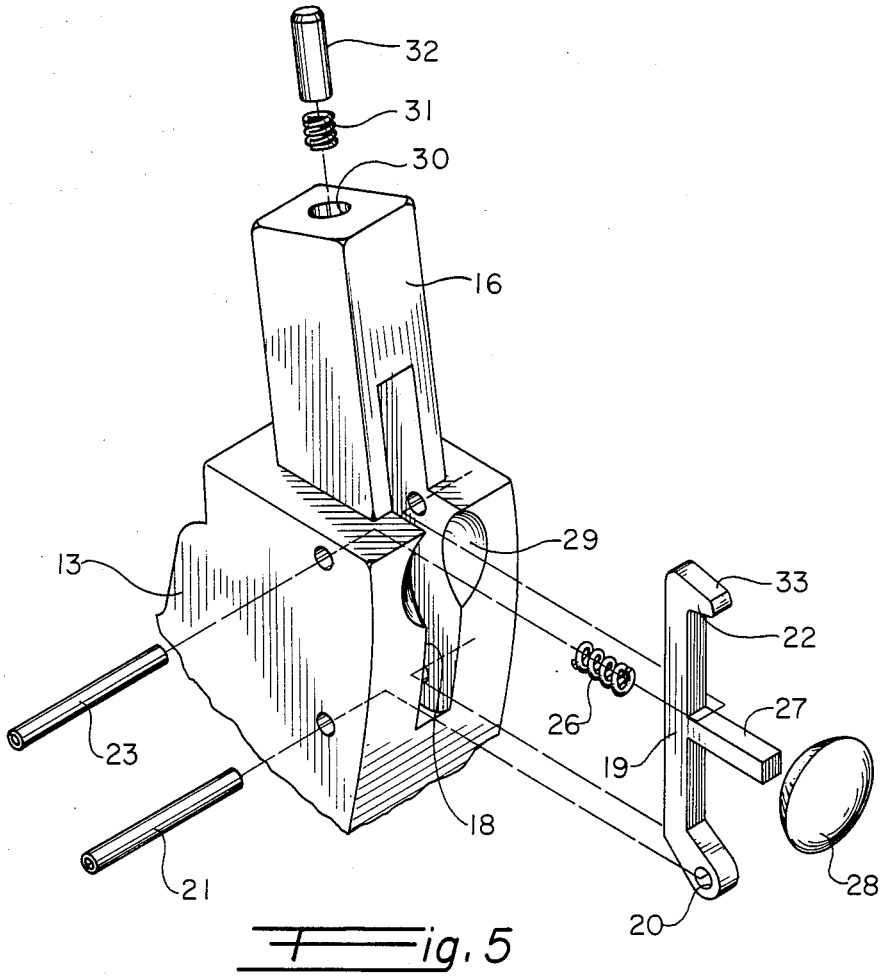
FIG. 5 is an exploded view, in perspective, of the first end of one of the shanks, broken away from the remainder of the pliers and having the interchangeable jaw removed therefrom for the sake of clarity.

With reference to FIGS. 2, 3 and 5, in addition to FIG. 1, the means for removably securing each respective clamping jaw 15 on a respective shank 11—wherein each jaw 15 may be selectively secured to and removed from a respective first end of th shank 11 with a "snap action"—is illustrated.

Formed on the outermost portion of the first end 13 of each shank (handle member) 11 is an outermost stud portion 16. The stud 16 projects forwardly of the first end 13 of the shank 11 in a direction substantially away from both the pivotal connection (first pivot point) 12 between the shanks (handle members) 11 and from the second, opposite end 14 of the shank 11. Preferably, each stud 16 is inclined by an acute angle in an inward direction for aiding in providing the transverse force component, as shall be discussed later.

A desired removable, interchangeable clamping jaw 15 is removably received on the stud portion 16 formed on a respective first end 13 of a shank 11. Each clamping jaw 15 has a recess 17 formed therein that is shaped substantially complementary to the stud 16. Formed thusly, each jaw 15 is slidably and removably received on a stud 16 for concomitant movement therewith. In this fashion, movement of the shanks 11 in the first direction moves the jaws 15 concomitantly therewith for clamping the workpiece therebetween. Further, movement of the shanks 11 in the second opposite direction moves the jaws concomitantly therewith for unclamping of the workpiece.

In the practice of the present invention, it is preferred to provide a transverse force component for improved clamping of a workpiece therebetween. Such a transverse force component is provided herein by forming the stud 16, so that it is inclined in an inward direction by an acute angle and further by forming the recess 17 in each jaw 15, so that it is shaped complementary to the stud 16, being inclined in an inward direction by a corresponding acute angle. In this fashion, when the jaw 15 is received on the stud 16 of each shank 11, the jaw 15 is inclined inwardly towards the longitudinal axis and the other jaw 15, thereby providing the transverse force component.

Figure 4:
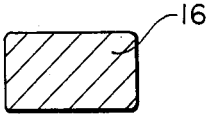
FIG. 4 is a section view, taken along lines 4—4 of FIG. 1, showing a preferred geometric shape for providing a keying means between the first end of a shank and a respective jaw.
Figure 4A:
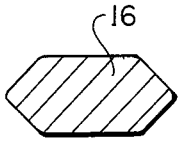
FIG. 4A corresponds substantially to that of FIG. 4, but illustrates an alternate cross-sectional configuration.

With additional reference to FIGS. 4 and 4A, it is preferred to also provide means for keying each jaw 15 to a respective stud 16 of the first end 13 of a shank 11, whereby relative rotation therebetween is prevented. In this regard, such means is preferably provided by forming the stud 16 so that it has a particular, non-circular geometric shape and by forming the recess 17 in the jaw 15 so that it has a substantially complementary, non-circular geometric shape. In the practice of this invention, geometric shapes such as a rectangle (FIG. 4) or a truncated hexagon (FIG. 4A) are preferred.

With further reference to FIGS. 1, 2, 3 and 5, means is provided for removably securing each respective clamping jaw 15 on a respective shank 11, wherein each jaw 15 may be selectively secured to and removed from the shank 11. Each shank 11 has a slot 18 formed therein between the stud 16 on the first end 13 and the first pivot point 12 (the pivotal connection between the handle members). This slot 18 opens externally of the shank 11 in a direction away from the shank and from the longitudinal axis LA of the pliers 10.

A latch 19 is pivotably mounted in the slot 18 on a second pivot point 20. The second pivot point 20 is provided by a first pin 21. The first pin 21 is disposed transversely through the slot 18 on an axis that is substantially parallel to the transverse axis TA of the pivotable connection (the first pivot point) 12.

Preferably, the latch 19 is substantially elongated in shape (having an elongated body portion) having a first end and a second opposite end. Preferably, the first pin 21 (and the second pivot point 20 which it provides) is located at substantially the second end of the latch 19. In this fashion, the second pivot point 20 provides for pivotal movement of the latch 19 thereabout in a first outward securing direction and in a second inward releasing direction.

A finger 22 is formed on the first end of the latch 19. This finger 22 projects outwardly in a direction away from the transverse axis of the first pivot point 12. Formed thusly, the finger 22 is moved concomitantly with the latch 19 between a frist, seated position, wherein the jaw 15 is secured in place and a second, unseated position, wherein the jaw 15 is unsecured.

Disposed transversely through each of the slots 18, outwardly of the latch 19, is a respective second (stop) pin 23 which is supported by the first end 13 of the shank 11. Positioned thusly, the second pin 23 acts as a stop to aid in restricting the pivoting motion of the latch 19 by preventing and restricting movement of the latch 19 in the first outward securing direction by contacting the elongated body portion of the latch 19.

Each jaw 15 further has a notch 24 formed therein. Each of the notches 24 has an open end which is in communication with the recess 17 in the jaw 15 and, when the jaw 15 is fully seated on the stud 16, the notch 24 is in communication with the slot 18 in the shank 11. Formed thusly, when the finger 22 is moved in the first outward direction, the notch 24 is positioned so as to receive the finger 22 therein, permitting the finger 22 to be moved into its first seated position. In this fashion, the jaw 15 is secured to a respective shank 13.

Resilient biasing means is positioned in a first blind bore 25 formed in the shank 11, anteriorly of the slot 18 and which is in communication with the slot 18. Preferably, this resilient means comprises a coil spring 26 which is disposed in the blind bore 25 so as to have one end extending therefrom, bearing against the body of the latch 19 at, preferably, a position being substantially intermediately of the first and second ends thereof. Positioned thusly, spring 26 constantly biases the latch 19 outwardly of the pliers in the first outward direction. Such biasing permits the finger 22 to be moved into its first seated position. The second (stop) pin 23 prevents the spring 26 from "overbiasing" the latch 19.

Each latch 19 further has an arm or manually-actuatable projecting portion 27. Portion 27 may be manually depressed to overcome the biasing force of the spring 26 and to move (or depress) the latch within the slot 18 in the second inward releasing direction against the biasing force of the spring 26. In this fashion, the finger 22 is moved into its second, unseated position wherein it is "clear" of, or removed from the notch 24, thereby unsecuring (or releasing) the jaw 15 from the shank 11.

Preferably, the manually-actuatable portion 27 is an extension which is integrally formed on the latch 19 substantially intermediately of the first and second ends thereof. This manually-actuable portion 27 extends outwardly in a direction away from the transverse axis of the first pivot point 12. In this manner, when the manually-actuatable portion 27 is depressed, the finger 22 moves in the second, inward releasing direction, such that the finger 22 clears the notch 24 on the jaw 15 and such that the finger 22 is moved into its second unseated position, thereby unsecuring the jaw 15 from its respective shank 11 for subsequent removal therefrom.

It is further preferred that a button 28 be integrally formed on the manually-actuatable portion 27 opposite of the latch 19. This button 28 receives and accommodates the finger or thumb of the user of the device, whereby making the depression of the portion 27 easier and more comfortable.

The shanks 11 are further formed having an arcuate cut out portion 29 which is adjacent to the slot 18. Disposed within the arcuate cut-out portion 29 is the manually-actuatable projecting portion 27. Disposed thusly, the manually-actuatable projecting portion 27 of the latch 19 is disposed within the extended contours of the shank 11. In this fashion, the user's thumb or finger may be received in the cut-out portion 29 to depress the manually-actuatable projecting portion 27 of the latch 19.

Means is also provided for enabling each jaw 15 to be received on and removed from a respective first end 13 with a "snap action".

The recess 17 and the stud 16 are each formed so that the jaw 15 is slidably received on the stud 16 with an increasing snugness therebetween as the jaw 15 is moved toward the shank 11. The uppermost portion of each stud 16 has a blind bore 30 formed theren. This blind bore 30, like the stud 16 in which it is formed, extends outwardly away from the second end 14 of the shank 11 and away from the pivotable connection 12 between the shanks (handle members) 11.

Disposed in the blind bore 30 is a second coil spring 31. A biasing pin 32 is disposed in the bore 30, such that the spring 31 bears against the pin 32, constantly biasing the pin 32 in an upward direction away from the shank 11 and into its first unseated position. Preferably, the outermost circular edge of the bore 30 on the stud 16 is swaged over in such a manner to allow the resiliently-biased pin 32 to be partially exposed (beyond the outer face 16A of the stud 16) yet sufficient to preclude the pin 32 from "popping" out of the stud 16 when the jaw 15 is removed therefrom. Sliding movement of the jaw 15 towards the shank 11 causes the jaw 15 to contact the pin 32 within the recess 17 thereof. Further movement of the jaw 15 downwardly towards the shank 11 overcomes the biasing force of this second resilient means, thereby compressing the spring 31 and depressing the pin 32 into its second seated position within the bore 30. In this fashion, this second resilient means constantly urges the jaw 15 into a direction wherein it is released from the stud.

The means for providing the "snap action" also includes the finger 22 of each latch 19 being formed with a sloping cam surface 33. Positioned as described above, the cam surface 33 of the finger 22 slopes away from the transverse axis of the first pivot point 12 and from the longitudinal axis of the pliers 10. Also, the notch 24 has an edge portion formed at the open end thereof and defined by the communication between the notch 24 and the recess 17 of the jaw 15. Movement of the finger 22 in the first outward and second inward directions between the first seated and second unseated positions causes the sloping cam surface 33 of each finger 22 to cooperate with the edge portion of a respective notch 24, so as to enable or provide each jaw to be received on and removed from a respective first end 13 with a "snap action". Additionally, the biasing action of the second resilient means provides for the creation of a biasing force (tension) which increases such "snap action" and which further allows the jaw to "pop on" and partially "pop off" a respective stud 16.

Accordingly, the jaw 15 may be slidably disposed on the stud 16 by a slight pushing action. This downward sliding motion overcomes the biasing force of the second resilient means (spring 31), thereby compressing the spring 31 and moving the biasing pin 32 from its first unseated position and into its second seated position. As the jaw 15 is further slid into place, the lower portion thereof engages the sloping cam surface 33 of the finger 22 and moves the finger 22 in its inward releasing direction overcoming the resilient means. When the jaw is fully slid downwardly, so that it is fully seated on the first end 13 of the shank 11, the finger 22 moves in its outward securing direction and "snaps" into the notch 24 where it is received in its first seated position, wherein the jaw 15 is secured in place for use.

Referring to FIGS. 6A–6F, there is illustrated the sequence of removing a jaw 15, wherein the jaw "pops off" the stud by a slight amount with a "snap action" for subsequent manual removal and replacement with a different (but interchangeable) jaw.

Figure 6A:
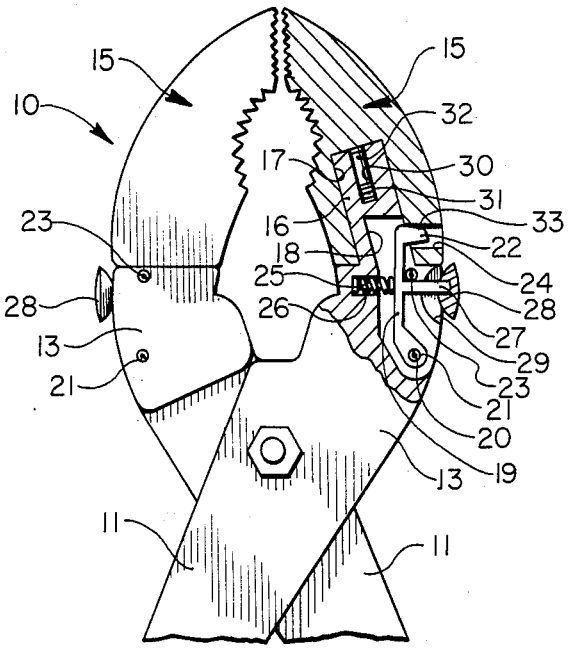
FIGS. 6A–6F schematically illustrate removal of one of the interchangeable jaws from the pliers.

With reference to FIG. 6A (and as was discussed previously) when a jaw 15 is secured on a respective first end 13 of a shank 11, spring 31 is fully compressed; and the biasing pin 32 is in its second seated position within the bore 30, thereby providing additional tension for holding the jaw 15 in place. Also, the finger 22 is in its first seated position in the notch 24 (being biased in that position by the spring 26), whereby the jaw 15 is removably secured on the first end 13.

Figure 6B:
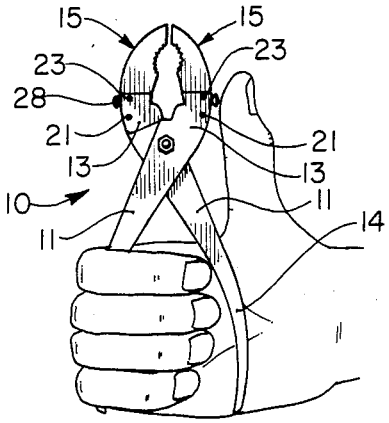

When it is desired to remove or change the particular jaw 15, the user (utilizing only one hand) needs merely to depress the button 28 (see FIG. 6B).

Figure 6C:
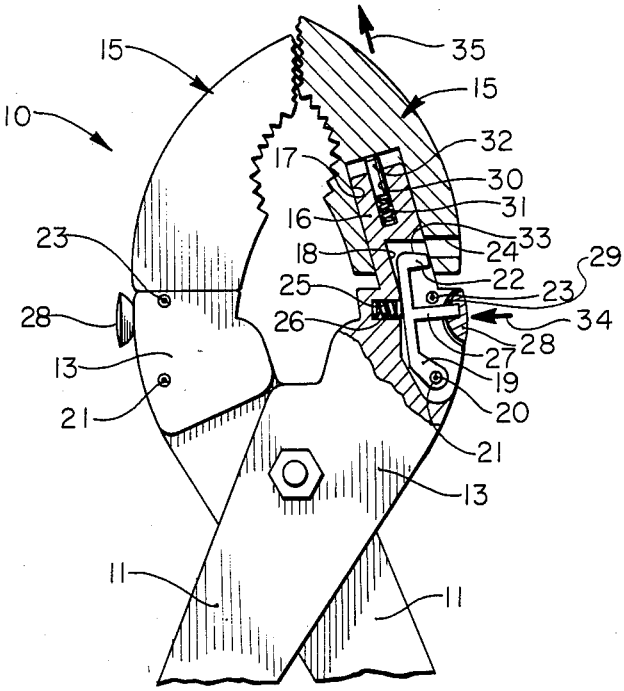
Figure 6D:
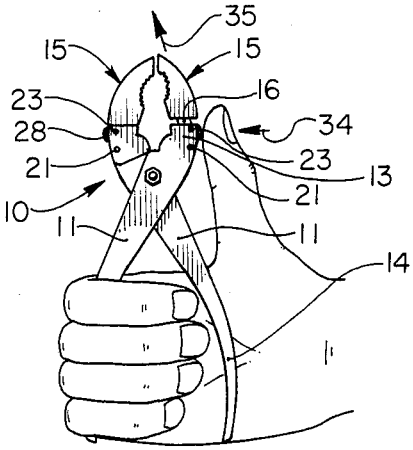

Referring to FIGS. 6C and 6D, depression of the button 28 (in the direction of arrow 34) activates the manually-actuatable portion 27, overcoming the biasing action of the spring 26 and moving the latch 19, having the finger 22 thereon, into its second, unseated position, wherein the jaw 15 is unsecured or released from the respective stud 16.

Pivotal movement of the latch 19 (and the finger 22) in the inward releasing direction, from its first seated position within the notch 24 into its second unseated position, causes the cam surface 33 to engage the edge portion of the notch 24. Further pivotal movement of the latch 24 causes the cam surface 33 of the finger 22 to contact the jaw 15 and force the jaw 15 upwardly (in the direction of arrows 35) as the jaw 15 is released from the stud 16. Additionally, the biasing action of the second resilient means (spring 31) contributes in forcing the jaw 15 upwardly (in the direction of arrow 35 shown in FIG. 6D) so that the jaw 15 is released (or unsecured) from the first end 13 of the shank 11 with a "snap action", thereby causing the jaw 15 to partially "pop off" the stud 16 formed on said first end 13.

Figure 6E:
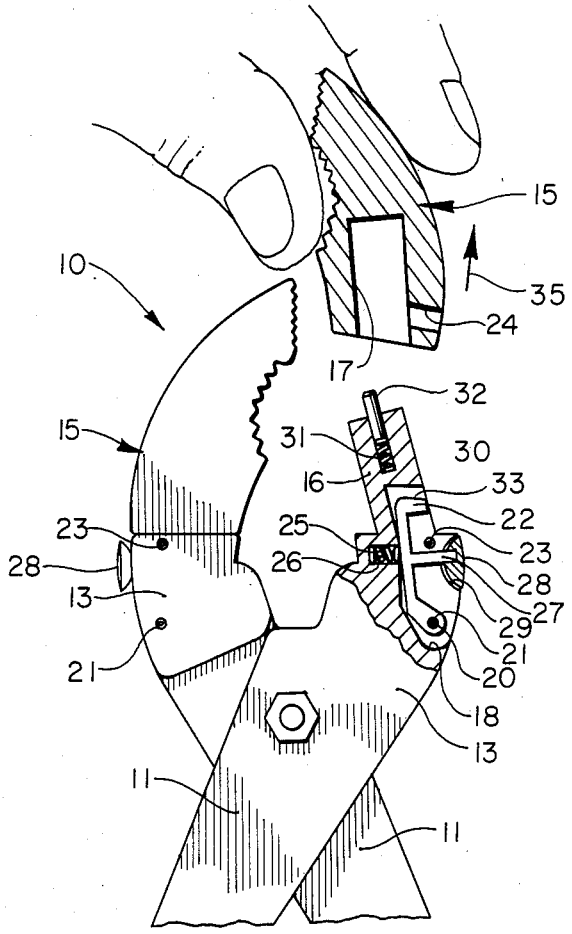
Figure 6F:
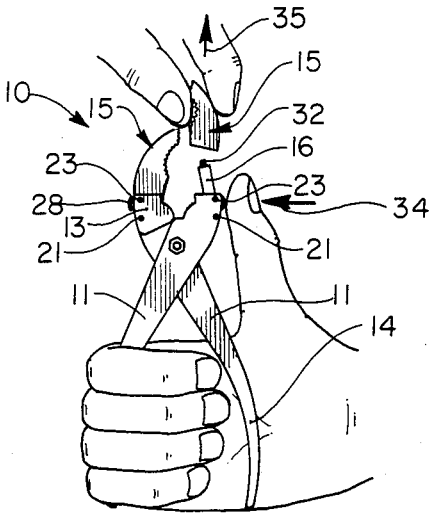

Referring to FIGS. 6E and 6F, once the jaw 15 is partially released (or unsecured) from the first end 13, it may then be removed therefrom by a manual sliding movement in the direction of arrow 35.

Figure 7:
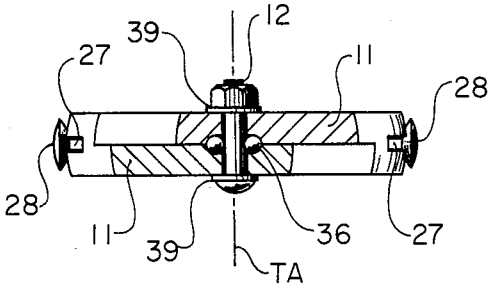
FIG. 7 is a section view, taken along the lines 7—7 of FIG. 1 and drawn to an enlarged scale, and showing an anti-friction bearing between the respective shanks of the pliers.

With reference to FIG. 7, an anti-friction bearing is disposed and retained internally between the shanks 11 of the pliers 10 at the first pivot point 12. The bearing constitutes a ball bearing 36; however, a roller bearing or any other suitable anti-friction bearing may be employed, if desired; and as will be readily understood by those skilled in the art, facilitates movement of the shanks 11 and operation of the pliers 10. The shanks 11 are secured by a bolt 37 and nut 38 and, preferably, a washer 39 is carried by the bolt 37 and is disposed on each side of the shanks 11.

Obviously, many modifications may be made without departing from the basic spirit of the present invention. For example, the pliers may, if desired, be formed so that only one jaw is removable, with the other jaw being integral with the pliers. Accordingly, it will be appreciated by those skilled in the art that within the scope of the appended claims, the invention may be practiced other than has been specifically described herein.

What is claimed is:

1. A pliers for clamping and unclamping a workpiece, said pliers comprised of:

a pair of shanks having a longitudinal axis therebetween, each of said shanks having a first end and a second opposite end, and each of said shanks further being pivotably connected to each other at a first pivot point for pivotal movement in a first direction, wherein the first ends of each shank are moved towards one another, and in a second opposite direction, wherein the first ends of each shank are moved away from one another;

a pair of clamping jaws, each respective jaw being removably received on a respective first end of a shank for concomitant movement therewith, such that movement of the shanks in the first direction moves the jaws concomitantly therewith for clamping the workpiece therebetween, and further such that movement of the shanks in the second opposite direction moves the jaws concomitantly therewith for unclamping the workpiece;

each of said clamping jaws engaging its shank along two planes, one of which is substantially perpendicular to the longitudinal axis, and the other of which is inclined relative to the longitudinal axis, thereby providing improved clamping of the workpiece therebetween;

means for removably securing each respective clamping jaw on a respective shank, wherein each jaw may be selectively secured to and unsecured from said shank; and said means for removably securing each jaw on a respective shank including a manually-actuatable detent latching means for enabling each jaw to be received on and removed from a respective shank with a "snap action", wherein each jaw may be mounted on a respective shank with an audible click; and wherein upon actuation of the detent latching mechanism, each jaw is partially lifted off of its respective shank, whereby the jaw may be slidably removed from its respective shank.

2. The pliers of claim 1, further including an anti-friction bearing positioned ithe first pivot point between the shanks.

3. The pliers of claim 1, wherein the first pivot point is positioned substantially intermediately of the first and second opposite ends of each shank.

4. The pliers of claim 1, wherein the first pivot point is formed on a transverse axis, being transverse to the pliers, said transverse axis substantially passing through the longitudinal axis perpendicularly thereof.

5. The pliers of claim 1, further including means for keying each jaw to a respective first end of a shank, thereby preventing relative rotation therebetween.

6. The pliers of claim 1, further comprised of:

the first end of each respective shank having an outermost stud portion projecting forwardly thereof, substantially away from the second opposite end thereof; and each clamping jaw having a recess formed therein being substantially complementary to the stud portion, whereby the jaw may be slidably and removably received on a respective stud formed on a first end of a shank for concomitant movement therewith.

7. The pliers of claim 6, further including each stud being inclined by an acute angle in an inward direction and the recess in each jaw also being inclined by an acute angle, whereby when the jaw is received on the stud of each shank, said jaw is inclined inwardly providing a transverse force component for clamping of the workpiece therebetween.

8. The pliers of claim 6, wherein the means for removably securing each jaw on a respective shank is comprised of:

the first pivot point being positioned between the first and second opposite ends of the shank, said first pivot point further being disposed about an axis transverse to the pliers;

each of the shanks further having a slot formed therein between the first end and the first pivot point, said slot opening externally of the shanks in a direction away from one another;

a latch pivotably mounted in each slot on a second pivot point about an axis substantially parallel to the transverse axis of the first pivot point, each latch having a finger projecting in a direction away from the transverse axis of the first pivot point;

each jaw having a notch formed therein, each said notch having an open end being in communication with a respective recess to receive a respective finger therein;

resilient means positioned within each slot for constantly biasing a respective latch outwardly of the pliers, so that the finger thereof is received in a respective notch, whereby each jaw is removably secured to the stud of a respective shank; and each latch further having a manually-actuatable portion which may be manually depressed to pivotably depress and move the latch within the slot against the bias of the resilient means, such that the finger clears the notch in the jaw, whereby the jaw is partially lifted off its respective shank unsecuring the jaw from the stud of a respective shank so that the jaw may thereafter be pulled off its respective shank for removal therefrom.

9. The pliers of claim 8, wherein each shank has a blind bore formed therein anteriorly of the slot and in communication therewith, and wherein the resilient means comprises a coil spring disposed in the blind bore and bearing against the latch.

10. The pliers of claim 8, wherein the manually-actuatable projecting portion of the latch is disposed within an arcuate cut-out portion of the shanks adjacent to the slot, such that the manually-actuatable projecting portion of the latch is disposed within the extended contours of the shank, and such that the user's thumb or finger may be recieved in the cut-out portion to depress the manually-actuatable projecting portion of the latch.

11. The pliers of claim 8, wherein the means for enabling each jaw to be received on and removed from a respective first end with a "snap action" includes:

the finger of each latch having a sloping cam surface; and each notch further including an edge portion, wherein the sloping cam surfaces of each latch cooperates with the edge portion of a respective notch.

12. A pliers for clamping and unclamping a workpiece, said pliers comprised of:

a pair of shanks, each of said shanks having a first end and a second opposite end, and each of said shanks further being pivotably connected to each other at a first pivot point for pivotal movement in a first direction, wherein the first ends of each shank are moved towards one another, and in a second opposite direction, wherein the first ends of each shank are moved away from one another;

a pair of clamping jaws, each respective jaw being removably received on a respective first end of a shank for concomitant movement therewith, such that movement of the shanks in the first direction moves the jaws concomitantly therewith for clamping the workpiece therebetween, the further such that movement of the shanks in the second opposite direction moves the jaws concomitantly therewith for unclamping the workpiece;

each of said clamping jaws being inclined inwardly, thereby providing a transverse force component for clamping of the workpiece therebetween;

the first end of each respective shank having an outermost stud portion projecting forwardly thereof, substantially away from the second opposite end thereof;

each clamping jaw having a recess formed therein being substantially complementary to the stud, whereby the jaws may be slidably and removably received on a respective stud formed on a first end of a shank for concomitant movement therewith;

the first pivot point being positioned substantially intermediately of the first and second opposite ends of the shank, said first pivot point further being disposed about an axis transverse to the pliers;

each of the shanks further having a slot formed therein between the first end and the first pivot point, said slot opening externally of the shanks in a direction away from one another;

a latch pivotably mounted in each slot on a second pivot point about an axis substantially parallel to the transverse axis of the first pivot point, each latch having a finger projecting in a direction away from the transverse axis of the first pivot point;

each jaw having a notch formed therein, each said notch having an open end being in communication with a respective recess to receive a respective finger therein;

resilient means positioned within each slot for constantly biasing a respective latch outwardly of the pliers, so that the finger thereof is received in a respective notch, whereby each jaw is removably secured to the stud of a respective shank;

each latch further having a manually actuatable portion which may be manually depressed to pivotably depress and move the latch within the slot against the bias of the resilient means, such that the finger clears the notch in the jaw, whereby the jaw is partially lifted off its respective shank unsecuring the jaw from the stud of a respective shank so that the jaw may thereafter be pulled off its respective shank for removal therefrom;

the finger of each latch having a sloping cam surface; and each notch further including an edge portion, wherein the sloping cam surfaces of each latch cooperates with the edge portion of a respective notch, whereby each jaw may be received on and removed from a respective first end with a "snap action", so that the jaw may thereafter be pulled off its respective shank for removal therefrom.

13. In a pliers including a pair of handle members having a pivotable connection therebetween intermediately of the length of the handle members, the pivotable connection being disposed about an axis transverse to the pliers, the pliers further having a longitudinal axis intermediately of the handle members and substantially passing through the transverse axis perpendicularly thereof, the improvement in interchangeable jaws for the pliers, comprising each of the handle members having a first end, each of said first ends terminating on a common transverse plane being perpendicular to the longitudinal axis, each of said first ends having an outermost stud portion projecting forwardly thereof away therefrom at an acute angle relative to the common transverse plane and away from the pivotable connection between the handle members, a removable jaw received on each stud abutting the first end of the shank along the common transverse plane, each jaw having a recess formed therein at an acute angle relative to the common transverse plane complementary to the stud, whereby the jaw may be slidably and removably mounted on its respective stud included inwardly towards the longitudinal axis, such that when moved in the first direction the jaws contact one another along the longitudinal axis, means for keying the jaw to the stud against relative rotation therebetween, each of the handle members further having a slot formed therein between the stud and the pivotable connection between the handle members, the slot opening externally of the handle members in a direction away from the longitudinal axis of the pliers, a latch pivotably mounted in the slot about an axis substantially parallel to the transverse axis of the pivotable connection between the handle members, resilient means within the slot and constantly biasing the latch outwardly of the pliers, the latch having a finger projecting in a direction away from the transverse axis, the jaw having a notch formed therein having an open end being in communication with the recess to receive the finger, and the latch further having a manually-actuable portion which may be depressed to depress the latch within the slot against the bias of the resilient means, such that the finger clears the notch on the jaw, partially releasing the jaw and such that the jaw may thereafter be removed from the stud.

14. In a pliers including a pair of handle members having a pivotable connection therebetween intermediately of the length of the handle members, the pivotable connection being disposed about an axis transverse to the pliers, there pliers further having a longitudinal axis intermediately of the handle members and substantially passing through the transverse axis perpendicularly thereof, the improvement in interchangeable jaws for the pliers, comprising each of the handle members having an outermost stud portion projecting forwardly thereof away from the pivotable connection between the handle members, a removable jaw on each stud, each jaw having a recess formed therein complementary to the stud, whereby the jaw may be slidably and removably mounted on its respective stud, means for keying the jaw to the stud against relative rotation therebetween, each of the handle members further having a slot formed therein between the stud and the pivotable connection between the handle members, the slot opening externally of the handle members in a direction away from the longitudinal axis of the pliers, a latch pivotably mounted in the slot about an axis substantially parallel to the transverse axis of the pivotable connection between the handle members, resilient means within the slot and constantly biasing the latch outwardly of the pliers, the latch having a finger projecting in a direction away from the transverse axis, the jaw having a notch formed therein having an open end being in communication with the recess to receive the finger, and the latch further having a manually-actuatable portion which may be depressed to depress the latch within the slot against the bias of the resilient means, such that the finger clears the notch on the jaw, and such that the jaw may thereafter be removed from the stud, wherein each handle member further has a blind bore formed therein anteriorly of the slot and in communication therewith, and wherein the resilient means comprises a coil spring disposed in the blind bore and bearing against the latch.

15. The improvement of claim 14, further including means enabling the jaw to be received with a "snap action" on its respective stud.

16. The improvement of claim 15, wherein means enabling the jaw to be received with a "snap action" on its respective stud includes a sloping cam surface formed on the finger of the latch and cooperating with an edge portion of the notch in the jaw.

17. The improvement of claim 14, wherein each stud is inclined by an acute angle in a direction towards the longitudinal axis of the pliers, and wherein the recess in each jaw is also inclined by the acute angle.

18. The improvement of claim 14, wherein the manually-actuatable projecting portion of the latch is disposed within an arcuate cut-out portion of the handle members adjacent to the slot, such that the manually-actuatable projecting portion of the latch is disposed within the extended contours of the handle members, and such that the user's thumb or finger may be received in the cut-out portion to depress the manually-actuatable projecting portion of the latch. respective stud.

19. In pliers including a pair of handle members having a pivotable connection therebetween intermediately of the length of the handle members, the pivotable connection being disposed about an axis transverse to the pliers, the pliers further having a longitudinal axis intermediately of the handle members and substantially passing through the transverse axis perpendicularly thereof, the improvement in interchangeable jaws for the pliers, comprising each of the handle members having a first end, each of said first ends terminating on a common transverse plane being perpendicular to the longitudinal axis, each of said first ends having an outermost stud portion projecting forwardly thereof away therefrom at an acute angle relative to the common transverse plane and away from the pivotable connection between the handle members, a removable jaw received on each stud abutting the first end of the shank along the common transverse plane, each jaw having a recess formed therein at an acute angle relative to the common transverse plane complementary to the stud, whereby the jaw may be slidably and removably mounted on its respective stud inclined inwardly towards the longitudinal axis, such that when moved in the first direction the jaws contact one another along the longitudinal axis, means for keying the jaw to the stud against relative rotation therebetween, each of the handle members further having a slot formed therein between the stud and the pivotable connection between the handle members, the slot opening externally of the handle members in a direction away from the longitudinal axis of the pliers, a latch pivotably mounted in the slot about an axis substantially parallel to the transverse axis of the pivotable connection between the handle members, each stud being inclined by an acute angle in a direction towards the longitudinal axis of the pliers, a spring within the slot and constantly biasing the latch outwardly of the pliers, the latch having a finger projecting in a direction away from the transverse axis, the jaw having a notch formed therein having an open end being in communication with the recess to receive the finger, the finger having a sloping cam surface cooperating with an edge portion of the notch in the jaw, the latch further having a manually-actuatable portion which may be depressed to depress the latch within the slot, such that the finger clears the notch on the jaw, and such that the jaw may thereafter be removed from the stud, whereby each jaw is received with a "snap action" on its respective stud, the handle member having an arcuate cut-out portion adjacent to the slot for receiving the manually-actuatable projecting portion of the latch, such that the manually-actuatable projecting portion of the latch is disposed within the extended contours of the handle members, and such that the user's thumb or finger may be received in the cut-out portion to depress the manually-actuatable projecting portion of the latch.

20. The pliers of claim 19, further including an anti-friction bearing in the pivotable connection between the handle members.

21. In a pliers or the like, wherein the pliers has a pair of handle members arranged about a longitudinal axis of the pliers and pivotably connected together about an axis substantially transverse to the longitudinal axis of the pliers, and wherein the handle members each has a first end terminating on a common transverse plane, being perpendicular to the longitudinal axis, the combination of at least one interchangeable jaw, means for removably mounting the interchangeable jaw on the first end of the pliers along the common transverse plane, said means including each respective first end having a shank extending outwardly therefrom at an acute angle relative to the common transvese plane and a recess formed in each jaw at an acute angle relative to the common transverse plane being complementary to the stud, such that each jaw is received on a respective shank extending in a direction which is inclined inwardly towards the longitudinal axis of the pliers, such that when moved in the first direction the jaws contact one another along the longitudinal axis, said means for removably mounting the jaws on the first end accommodates a spring loaded detent "snap action" of the interchangeable jaw on the pliers, and further includes a manually-actuatable latch member accessible externally of the pliers; whereby upon the manual actuation of the latch member, the interchangeable jaw is partially unseated from the jaw, and whereby the interchangeable jaw may thereupon be manually removed from the pliers.

22. A pliers for clamping and unclamping a workpiece, said pliers comprised of:

a pair of shanks, each of said shanks having a first end and a second opposite end, and each of said shanks further being pivotably connected to each other at a first pivot point, for pivotal movement in a first direction, wherein the first ends of each shank are moved towards one another, and in a second opposite direction, wherein the first ends of each shank are moved away from one another;

a pair of clamping jaws, each respective jaw being removably received on a respective first end of a shank for concomitant movement therewith, such that movement of the shanks in the first direction moves the jaws concomitantly therewith for clamping the workpiece therebetween, and further such that movement of the shanks in the second opposite direction moves the jaws concomitantly therewith for unclampng the workpiece;

each of said clamping jaws being inclined inwardly, thereby providing a transverse force component for clamping of the workpiece therebetween;

means for removably securing each respective clamping jaw on a respective shank, wherein each jaw may be selectively secured to an unsecured from said shank; and said means for removably securing each jaw on a respective shank including a manually-actuatable latch means enabling each jaw to be removed from a respective shank, so that when manually actuated the jaw partially lits off its respective shank and wherein the jaw may thereafter be pulled off of its respective shank.

23. A pliers for clamping and unclamping a workpiece, said pliers comprised of:

a pair of shanks, each of said shanks having a first end and a second opposite end, and each of said shanks further being pivotably connected to each other at a first pivot point for pivotable movement in a first direction, wherein the first ends of each shank are moved towards one another, and in a second opposite direction, wherein the first ends of each shank are moved away from one another;

a pair of clamping jaws, each respective jaw being removably received on a respective first end of a shank for concomitant movement therewith, such that movement of the shanks in the first direction moves the jaws concomitantly therewith for clamping the workpiece therebetween, an further such that movement of the shanks in the second opposite direction moves the jaws concomitantly therewith for unclamping the workpiece;

means for removably securing each respective clamping jaw on a respective shank, wherein each jaw may be selectively secured to and unsecured from said shank; and said means for removably securing each jaw on a respective shank including a manually-actuatable latch means for enabling each jaw to be received on and removed from a respective shank with a "snap action", wherein the latch means may be manually actuated so that the jaw will partially lift off its respective shank, and wherein the jaw may thereafter be pulled off of its respective shank.

24. A pliers for clamping and unclamping a workpiece, said pliers comprised of:

a pair of shanks, each of said shanks having a jaw end and a handle end, a bolt extending transversely of the shanks such that each of said shanks are pivotably connected to each other at a pivot point for pivotal movement in a first direction, wherein the jaws are moved towards one another for clamping the workpiece therebetween; and in a second, opposite direction, wherein the jaws are moved away from one another for unclamping the workpiece;

at least one anti-friction bearing retained internally between the shanks of the pliers radially of the bolt at the pivot point;

the bolt having an end portion extending beyond a respective one of the shanks, and a nut carried on the extending end portion of the bolt, whereby the shanks are removably secured together, whereby the bearing may be conveniently replaced, and whereby the transverse force exerted on the bearing may be adjusted.

25. The pliers of claim 24, wherein the bearing is a ball bearing.

26. The pliers of claim 24, wherein the bearing is a roller bearing.

27. In a pair of pliers or the like, the combination of a pair of shanks joined together by a bolt to thereby form a pivot for the shanks, an anti-friction bearing between the shanks at the pivot, and interchangeable jaws removably carried on the shanks;

the bolt having an end portion extending beyond a respective one of the shanks; and a nut carried on the extending end portion of the bolt, whereby the shanks are removably secured together, whereby the bearing may be conveniently replaced, and whereby the transverse force exerted on the bearing may be adjusted.

28. The combination of claim 27, wherein the interchangeable jaws are inclined inwardly of the shanks.

29. In a pair of pliers or the like, wherein a pair of shanks are joined together at a pivot, the combination of an anti-friction bearing at the pivot, and interchangeable jaws removably carried on the shanks;

wherein the interchangeable jaws are inclined inwardly of the shanks;

wherein each of the interchangeable jaws is removably carried on the shank by a manually-actuated detent latching mechanism providing a "snap action"; and wherein each jaw may be mounted on a respective shank with an audible click; and wherein upon actuation of the detent latching mechanism, each jaw is partially lifted off of its respective shank, whereby the jaw may be slidably removed from its respective shank.

30. In a pair of pliers or the like, wherein a pair of shanks are joined together at a pivot, and wherein the pivot is disposed on an axis transverse to a longitudinal axis passing substantially through the pivot and disposed between the shanks, the combination of an anti-friction bearing at the pivot, and interchangeable jaws removably carried on the shanks, the interchangeable jaws being inclined inwardly of the shanks and towards the longitudinal axis, and each of the interchangeable jaws being removably carried on its respective shank by a detent mechanism providing a "snap action", wherein the dent includes a manually actuatable latch means for enabling each jaw to be received on and removed from its respective shank with the "snap action", wherein the latch means may be manually actuated so that the jaw will partially lift off its respective shank and wherein the jaw may thereafter be pulled off of its respective shank.

31. The combination of claim 30, wherein the anti-friction bearing comprises a ball bearing.

* * * * *